US006471056B1

(12) United States Patent
Tzeng

(10) Patent No.: US 6,471,056 B1
(45) Date of Patent: Oct. 29, 2002

(54) PORTABLE ELECTRONIC DEVICE PROTECTIVE COVER

(76) Inventor: Kuo-Chen Tzeng, 22/F., No. 54, Alley 3, Lane 182, Wenhua Rd., Sec. 2, Panchiao City, Taipei County (TW)

( * ) Notice: Subject to any disclaimer, the term of this patent is extended or adjusted under 35 U.S.C. 154(b) by 0 days.

(21) Appl. No.: 09/899,122

(22) Filed: Jul. 6, 2001

(51) Int. Cl.[7] ..... B65D 85/38
(52) U.S. Cl. ..... 206/320; 206/305; 150/154
(58) Field of Search ..... 206/305, 320, 206/316.1, 316.2, 576; 150/154, 165; 224/236; 383/25, 26

(56) References Cited

U.S. PATENT DOCUMENTS 3,295,576 A * 1/1967 Schmitt et al. ..... 206/316.2
4,119,249 A * 10/1978 Hanson ..... 224/236
4,141,401 A * 2/1979 Hindemit ..... 206/320
5,092,459 A * 3/1992 Ujianic et al. ..... 206/320
5,499,713 A * 3/1996 Huffer ..... 206/320
6,082,535 A * 7/2000 Mitchell ..... 206/320

* cited by examiner

*Primary Examiner*—Luan K. Bui
(74) *Attorney, Agent, or Firm*—Rosenberg, Klein & Lee

(57) ABSTRACT

A portable electronic device protective cover includes a loop-like plastic peripheral strip fitting the periphery of the electronic device to be protected, the loop-like peripheral strip having an insertion slot through which the electronic device to be protected is inserted into the inside of the portable electronic device protective cover, a transparent plastic top panel peripherally sealed to the top side of the loop-like peripheral strip by a high-frequency heat sealing apparatus, and a transparent plastic bottom panel peripherally sealed to the bottom side of the loop-like peripheral strip by a high-frequency heat sealing apparatus.

1 Claim, 6 Drawing Sheets

PORTABLE ELECTRONIC DEVICE PROTECTIVE COVER

BACKGROUND OF THE INVENTION

The present invention relates to a portable electronic device protective cover and, more particularly, to such a protective cover, which fits perfectly the shape of the portable electronic device to be protected.

FIG. 9 illustrates a remote controller protective sheath 1 constructed according to U.S. patent application Ser. No. 09/568,851, which was filed by the present inventor. This remote controller protective sheath 1 comprises a peripheral strip 11, a bottom cloth panel 13, and a transparent top panel 12. The peripheral strip 11, the bottom cloth panel 13 and the transparent top panel 12 are respectively attached to a frame mold, and then fastened together by a high-frequency heat sealing apparatus. The remote controller protective sheath 1 has an opening 14 disposed at one end between the two ends of the peripheral strip 11. The top panel 12 has an extension flap 121. After insertion of the remote controller 2 through the opening 14 into the inside of the protective sheath 1, the extension flap 121 is turned back and inserted into the opening 14 to close the opening 14. When turned back and inserted into the opening 14, two gaps 122 exist at two sides between the extension flap 121 and the two ends of the peripheral strip 11, and outside dust may pass through the gaps 122 into the inside of the protective sheath 1 to contaminate the remote controller 2.

SUMMARY OF THE INVENTION

The present invention has been accomplished to provide a portable electronic device protective cover, which eliminates the aforesaid problem. According to one aspect of the present invention, the protective cover comprises a loop-like plastic peripheral strip fitting the periphery of the electronic device to be protected, the loop-like peripheral strip having an insertion slot through which the electronic device to be protected is inserted into the inside of the portable electronic device protective cover, a transparent plastic top panel peripherally sealed to the top side of the loop-like peripheral strip by a high-frequency heat sealing apparatus, and a transparent plastic bottom panel peripherally sealed to the bottom side of the loop-like peripheral strip by a high-frequency heat sealing apparatus. According to another aspect of the present invention, hook and loop materials are provided at the loop-like peripheral strip, and adapted to close/open the insertion slot.

DETAILED DESCRIPTION OF THE PREFERRED EMBODIMENT

Figure 1:
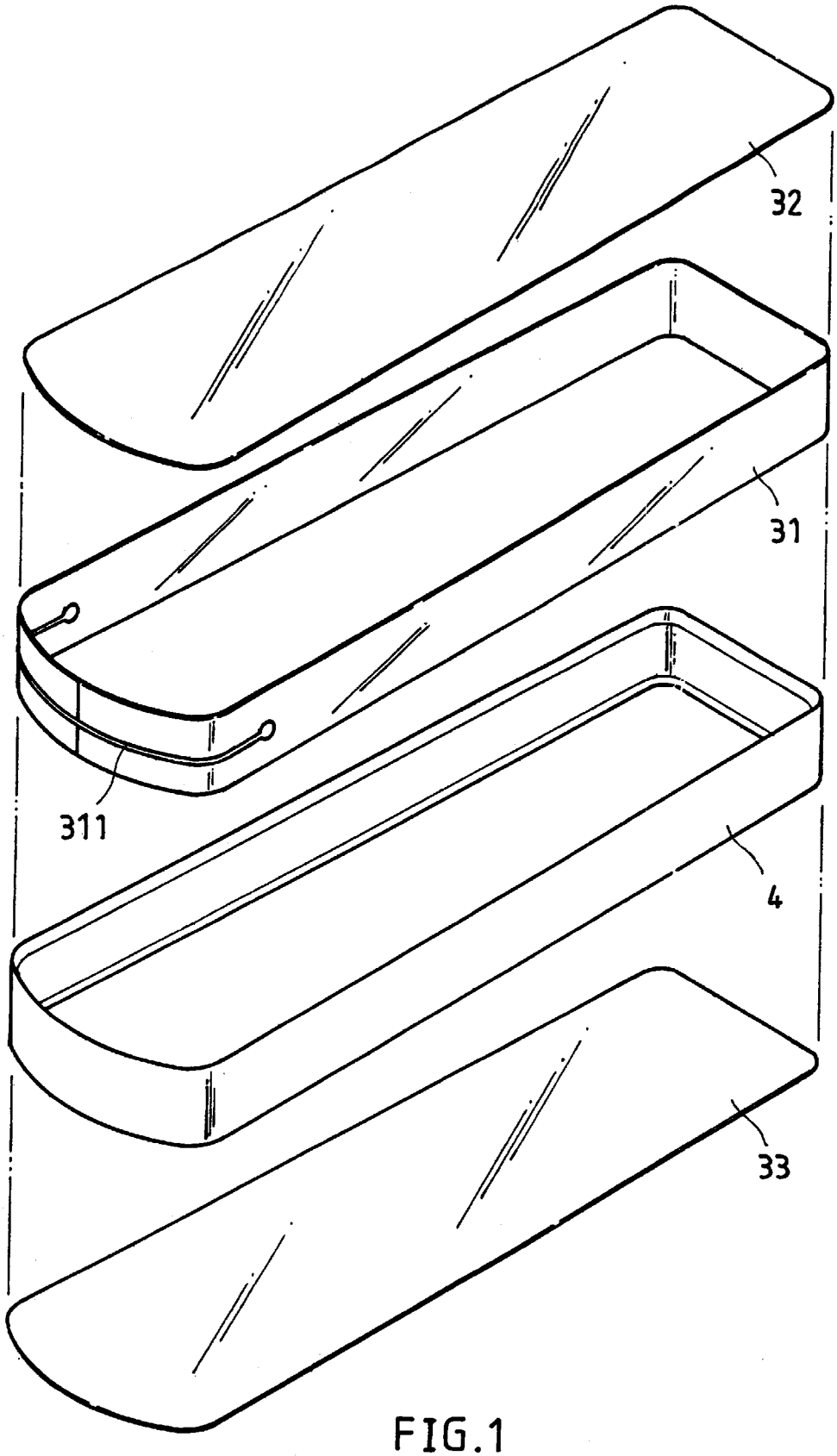
FIG. 1 an exploded view the loop-like peripherals trip, the top panel, the bottom panel, and the mold before the formation of the portable electronic device protective cover according to the present invention.
Figure 2:
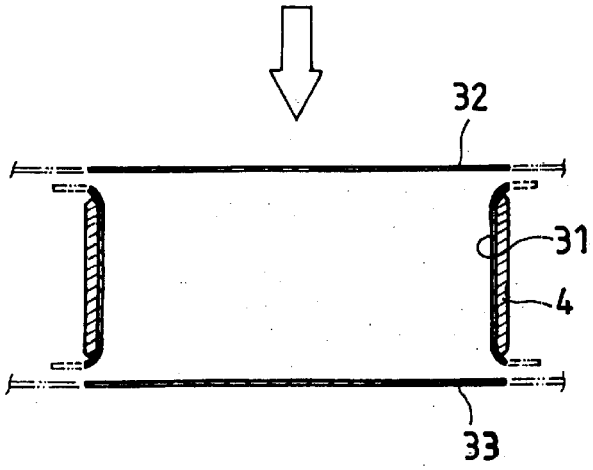
FIG. 2 is a sectional view showing the loop-like peripheral strip supported in the mold between the top panel and the bottom panel during heat-sealing according to the present invention.
Figure 3:
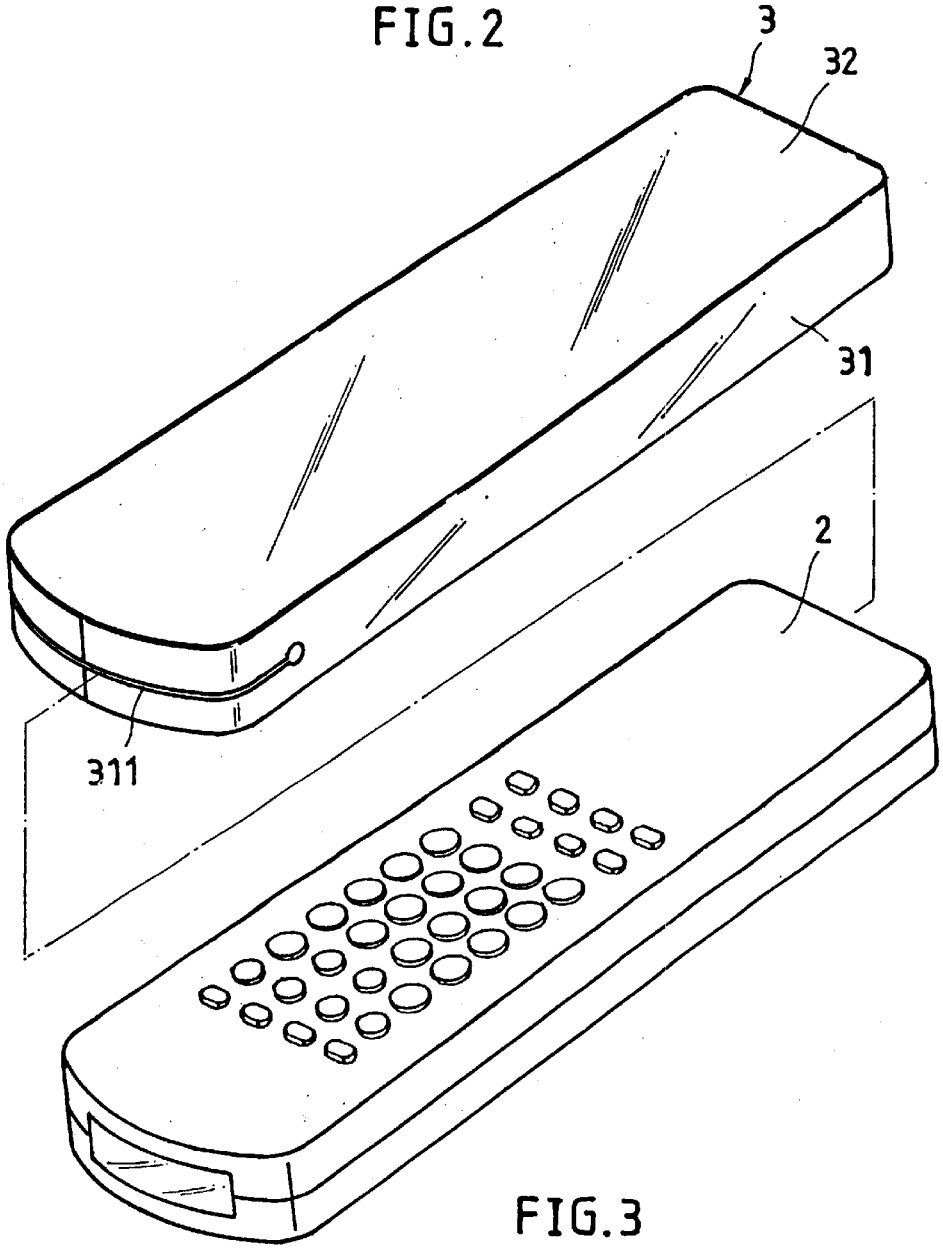
FIG. 3 illustrates the relationship between the protective cover and the remote controller to be protected according to the present invention.

Referring to FIGS. From 1 through 3, a protective cover 3 is made subject to a mold 4, which is an open frame fitting the height and width of the remote-controller 2 to be protected. The protective cover 3 comprises a peripheral strip 31, a transparent top panel 32, and a transparent bottom panel 33. The peripheral strip 31, the transparent top panel 32, and the transparent bottom panel 33 are respectively cut from transparent sheet material, for example, PVC (polyvinyl chloride) sheet material. The two ends of the peripheral strip 31 are sealed together, forming a loop. An insertion slot 311 is formed in one end of the loop-like peripheral strip 31. The loop-like peripheral strip 31 fits the inner diameter of the mold 4. After preparation, the loop-like peripheral strip 31 is put in the mold 4 and closely attached to the inside wall of the mold 4, and then the mold 4 with the loop-like peripheral strip 31 are put on the bottom panel 33 in a high-frequency heat sealing machine, and then the border of the bottom panel 33 is heat-sealed to the border of the bottom side of the loop-like peripheral strip 31 by the high-frequency heat sealing machine, and then the top panel 32 is covered on the mold 4 over the border of the top side of the loop-like peripheral strip 31 and heat-sealed to the border of the top side of the top side of the loop-like peripheral strip 31 by the high-frequency heat sealing machine. During sealing, the protruding portions of the loop-like peripheral strip 31, the top panel 32 and the bottom panel 33 outside the seal area are simultaneously cut away by the top and bottom cutting edges of the mold 4. After sealing, the desired protective cover 3 is obtained, which fits the shape of the remote controller 2. Through the insertion slot 311, the remote controller 2 is inserted into the inside of the protective cover 3.

Figure 4:
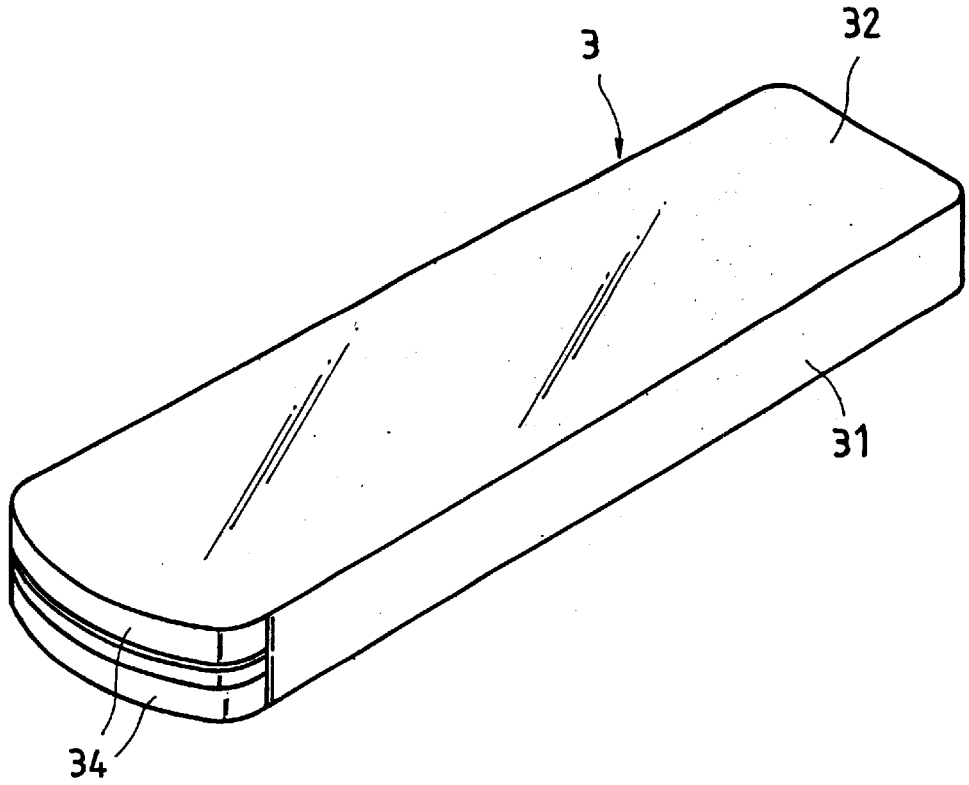
FIG. 4 illustrates hook and loop materials provided at the loop-like peripheral strip and closed according to the present invention.
Figure 5:
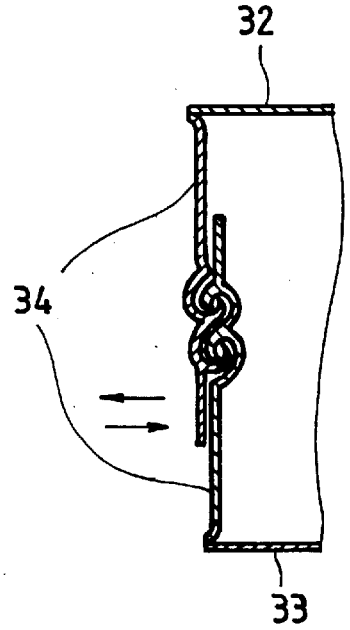
FIG. 5 is a sectional view in an enlarged scale of a part of FIG. 4.

Referring to FIGS. 4 and 5, hook and loop materials 34 are provided at one end of the peripheral strip 31 of the protective cover 3, and adapted to control the entrance of the insertion slot 311.

Figure 6:
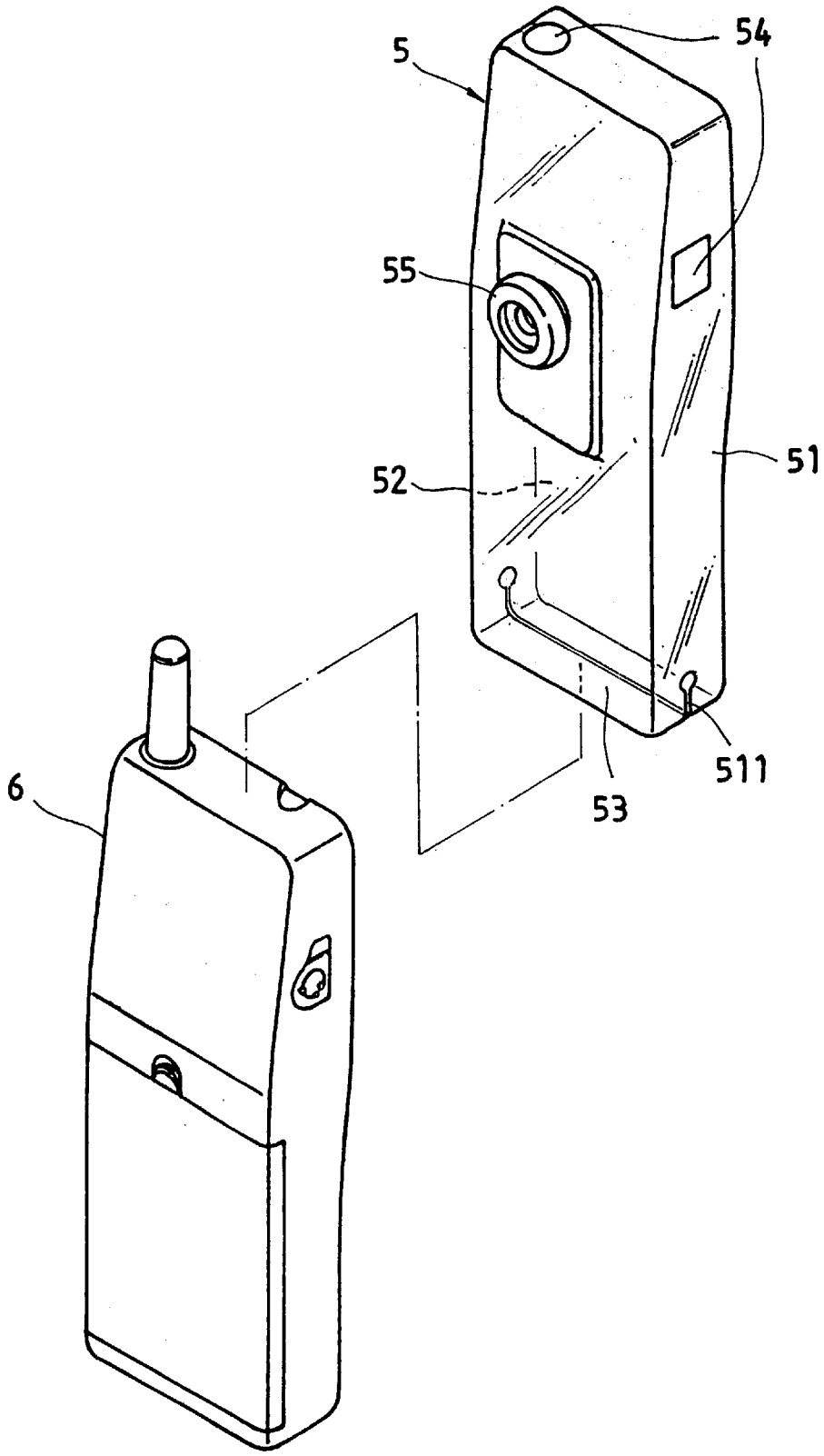
FIG. 6 illustrates the relationship between a cellular telephone protective cover and a cellular telephone according to the present invention.

Referring to FIG. 6, the protective cover 5 fits the shape of a cellular telephone 6, comprising a loop-like peripheral strip 51, a transparent top panel 52 peripherally sealed to the periphery of the top side of the loop-like peripheral strip 51, and a transparent bottom panel 53 peripherally sealed to the periphery of the bottom side of the loop-like peripheral strip 51, an insertion slot 511 in the loop-like peripheral strip 51 through which the cellular telephone 6 is inserted into the inside of the protective cover 5, a fastener 55 fixedly provided at the bottom panel 53 for fastening, and holes 54 formed in the loop-like peripheral strip 51 corresponding to the antenna and power switch of the cellular telephone 6.

Figure 7:
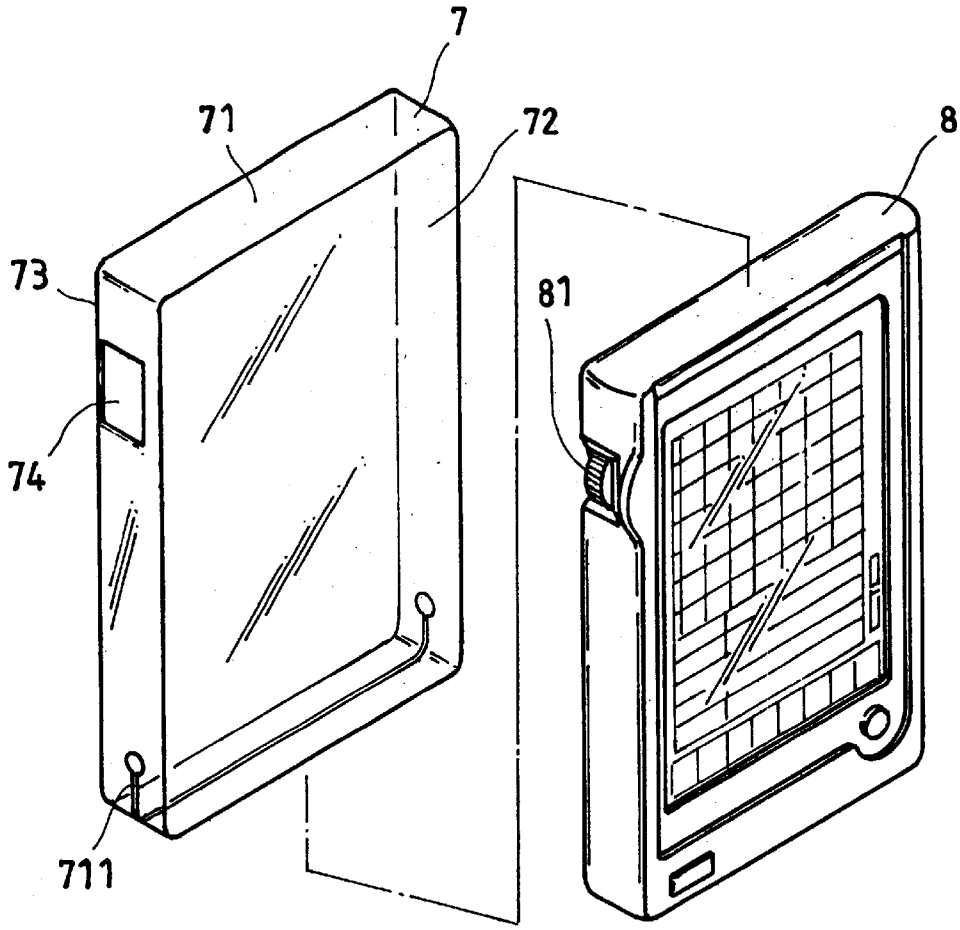
FIG. 7 illustrates the relationship between a PDA protective cover and a PDA according to the present invention.

Referring to FIG. 7, the protective cover 7 fits the shape of a PDA (personal digital assistant) 8, comprising a loop-like peripheral strip 71, a transparent top panel 72 peripherally sealed to the periphery of the top side of the loop-like peripheral strip 71, and a transparent bottom panel 73 peripherally sealed to the periphery of the bottom side of the loop-like peripheral strip 71, an insertion slot 711 in the loop-like peripheral strip 71 through which the PDA 8 is inserted into the inside of the protective cover 7, and a hole 74 formed in the loop-like peripheral strip 71 corresponding to the power switch 81 of the PDA 8.

Figure 8:
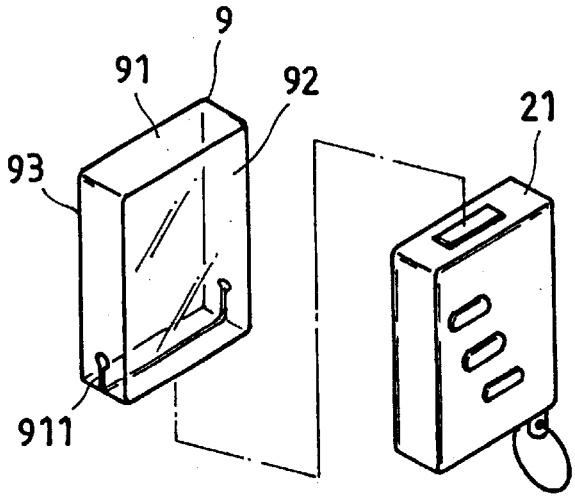
FIG. 8 illustrates the relationship between an electric steel rolling door remote controller protective cover and an electric steel rolling door remote controller according to the present invention.
Figure 9:
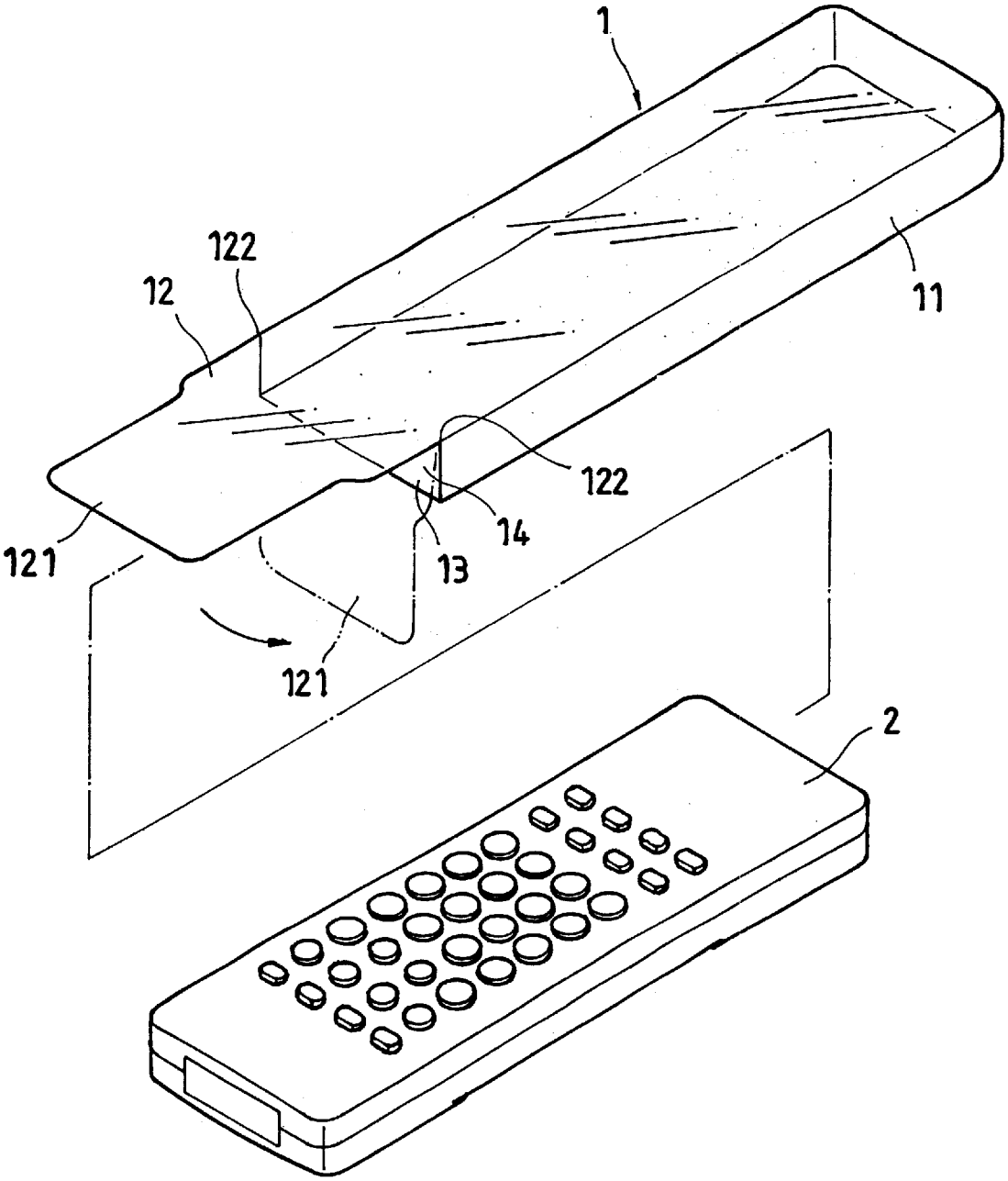
FIG. 9 PRIOR ART
FIG. 9 illustrates the relationship between a remote controller protective cover and a remote controller according to the prior art.

Referring to FIG. 8, the protective cover 9 fits the shape of an electric steel rolling door remote controller 21, comprising a loop-like peripheral strip 91, a transparent top panel 92 peripherally sealed to the periphery of the top side of the loop-like peripheral strip 91, and a transparent bottom panel 93 peripherally sealed to the periphery of the bottom side of the loop-like peripheral strip 91, and an insertion slot 911 in the loop-like peripheral strip 91 through which the electric steel rolling door remote controller 21 is inserted into the inside of the protective cover 9.

A prototype of portable electronic device protective cover has been constructed with the features of FIGS. 1~8. The portable electronic device protective cover functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A portable electronic device protective cover having a shape corresponding to an electronic device to be protected, comprising:

a peripheral strip made of plastic sheet material and having a loop-shaped contour for fitting a periphery of the electronic device to be protected, said peripheral strip having a top side, a bottom side, and a longitudinally extended insertion slot through which the electronic device to be protected is inserted into an interior of the portable electronic device protective cover, said insertion slot having a pair of spaced longitudinally extending peripheral edges and a pair of substantially circular openings respectively formed at opposing longitudinal ends of said insertion slot, each of said openings having a diameter greater than said spacing of said peripheral edges of said insertion slot;

a transparent top panel made of transparent plastic sheet material and peripherally sealed to said top side of said peripheral strip by a high-frequency heat sealing apparatus; and a transparent bottom panel made of transparent plastic sheet material and peripherally sealed to said bottom side of said peripheral strip by a high-frequency heat-sealing apparatus.

* * * * *